United States Patent [19]

Schnell

[11] Patent Number: 4,722,635

[45] Date of Patent: Feb. 2, 1988

[54] METHOD AND DEVICE FOR COMPACTING SOIL

[75] Inventor: Hans G. Schnell, Hamburg, Fed. Rep. of Germany

[73] Assignee: Ballast-Nedam Groep N.V., Netherlands

[21] Appl. No.: 752,196

[22] PCT Filed: Oct. 25, 1984

[86] PCT No.: PCT/NL84/00036

§ 371 Date: Jun. 24, 1985

§ 102(e) Date: Jun. 24, 1985

[87] PCT Pub. No.: WO85/01972

PCT Pub. Date: May 9, 1985

[30] Foreign Application Priority Data

Oct. 25, 1983 [NL] Netherlands ..... 8303676

[51] Int. Cl.[4] ..... E01C 7/36

[52] U.S. Cl. ..... 404/76; 404/102; 404/133

[58] Field of Search ..... 404/75, 76, 102, 113, 404/133; 405/271

[56] References Cited

U.S. PATENT DOCUMENTS 3,909,148 9/1975 Vural et al. ..... 404/133
4,382,715 5/1983 Vural et al. ..... 404/133

FOREIGN PATENT DOCUMENTS 2809111 9/1979 Fed. Rep. of Germany ..... 404/113
786068 11/1957 United Kingdom ..... 404/133

*Primary Examiner*—James A. Leppink
*Assistant Examiner*—William P. Neuder
*Attorney, Agent, or Firm*—John P. Snyder

[57] ABSTRACT

When compacting soil a vibration mass bearing on the ground is caused to vibrate, wherein the vibration process is controlled in dependence on the behaviour of the mass spring system, part of which being constituted by the soil. Tests have shown that in comparison with fall weights soil can be compacted up to the same extent in a shorter period of time or can be compacted to a greater extent in a same period of time.

15 Claims, 18 Drawing Figures

FIG. 7
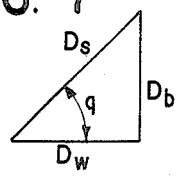
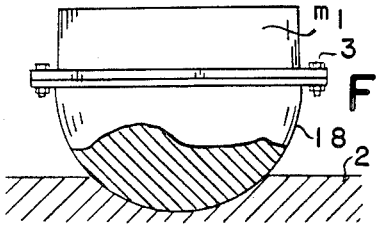
FIG. 8
FIG. 9
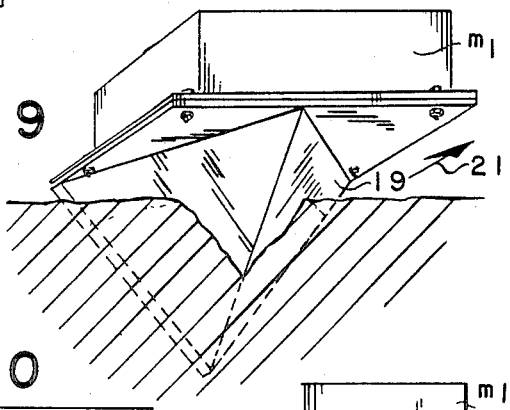
FIG. 10
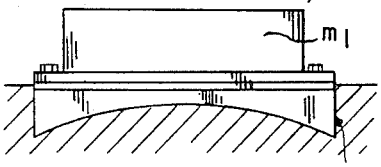
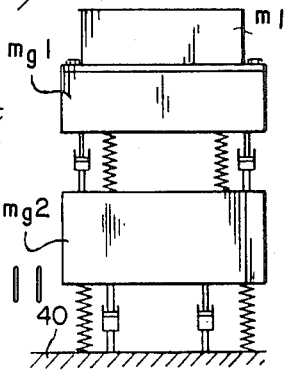
FIG. 11
FIG. 12
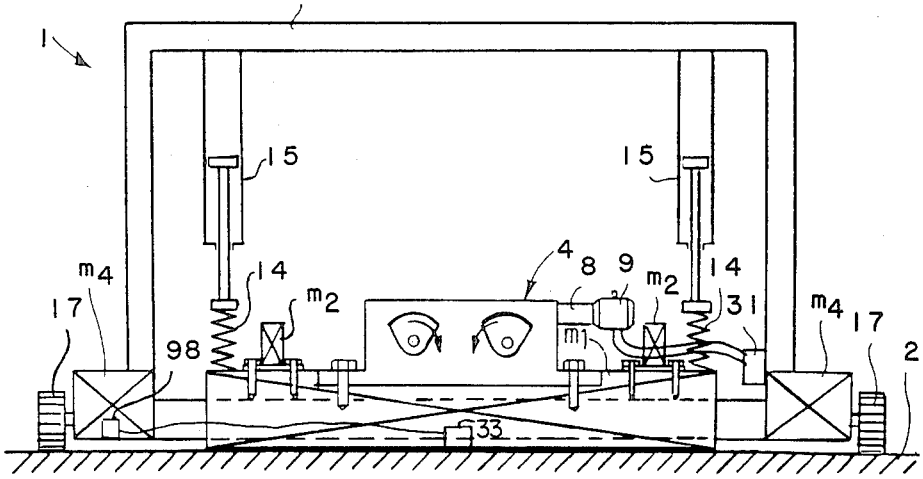

FIG. 13
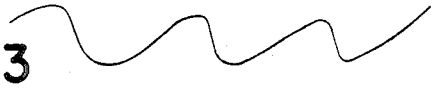
FIG. 14
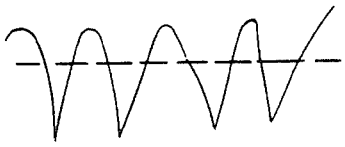
FIG. 15
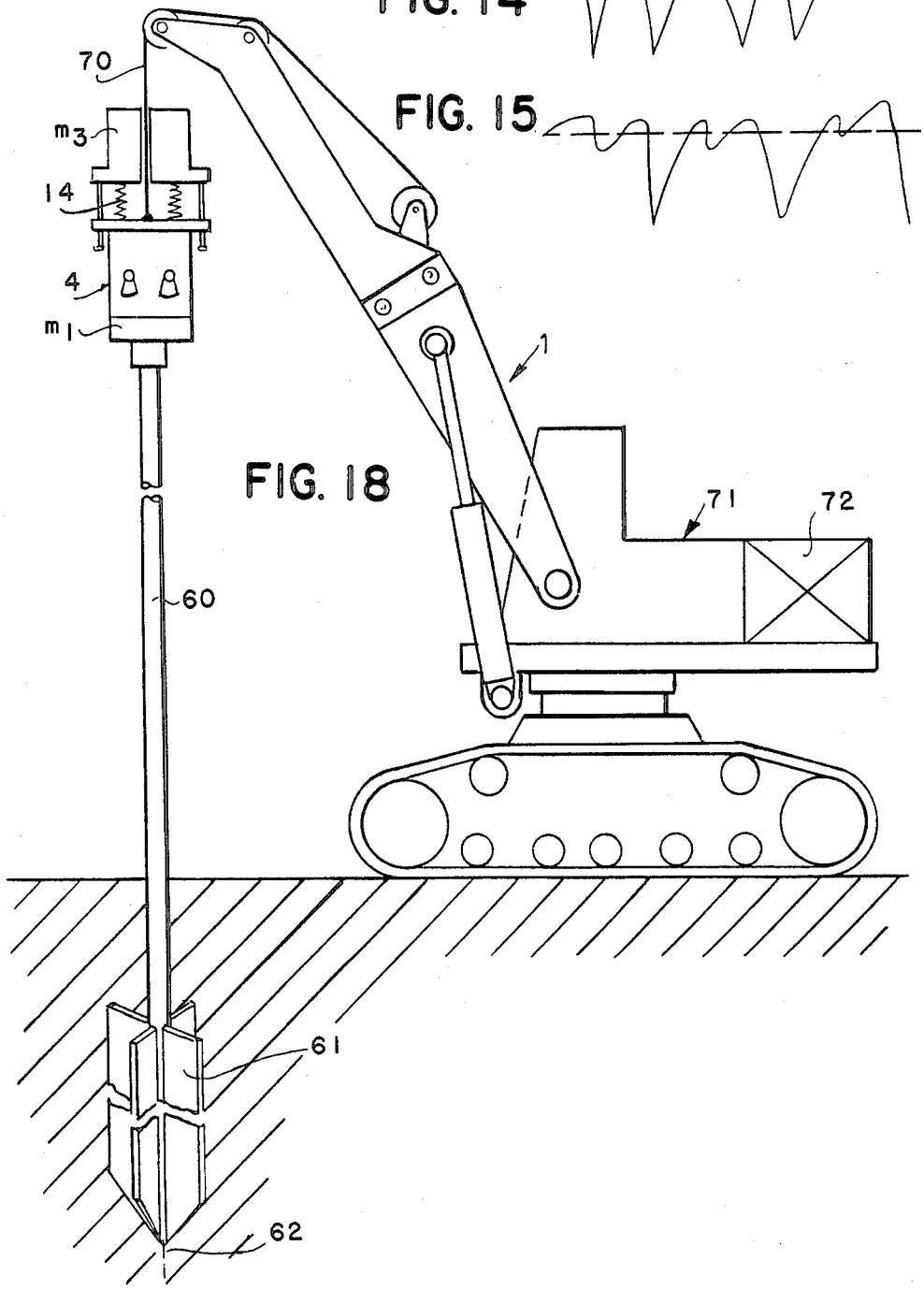
FIG. 18

METHOD AND DEVICE FOR COMPACTING SOIL

The invention relates to a method of compacting soil in which a vibration mass bearing on the ground is caused to vibrate by means of a vibration source.

Such a method is known. The invention has for its object to compact the soil in a shorter time, to a greater extent and/or by lower driving energy of the vibration source. This is achieved by applying one or more characteristics defined in the claims.

The invention furthermore provides a device described in the claims for carrying out the method according to the invention.

Experiments have shown that as compared to fall weights the soil can be worked to the same extent of compaction within a shorter time or better compacted within the same time.

The invention will be described more fully hereinafter with reference to a drawing.

The drawing shows schematically in

FIGS. 1 to 5, 12, 16, 17, 18 individually different devices embodying the invention for carrying out various kinds of the method in accordance with the invention.

FIG. 6 the device of FIG. 5 in a different working position,

FIG. 7 a diagram of the kinds of dynamic power,

FIGS. 8 to 10 different directing means usable in the device embodying the invention, FIG. 11 a mass spring system of soil during compaction, FIGS. 13, 14 and 15 vibration diagrams.

The device 1 of FIG. 1 for compacting soil 2 comprises a vibration mass $m_1$ bearing on the soil 2 to be compacted, to which a vibration source 4 is fastened by means of bolts 3. This vibration source 4 comprises a vibration aggregate having an eccentric mass known per se $m_{ex}$ consisting of two eccentric weights 7 turning in opposite senses 6 about axes 5 and being driven through a driving gear 8 by a hydraulic motor 9. The motor 9 is fed through hoses 30 by a pump aggregate 31. The centrifugal force F of the eccentric mass $m_{ex}$ is, at the maximum rate of the eccentric mass $m_{ex}$ higher than the overall weight G of the vibration mass $m_1$. As a result the vibration mass gets each time free of the soil so that each time an impact is applied to the soil 2, which has a strong compacting effect on the soil 2.

The device 1 of FIG. 2 is distinguished from that of FIG. 1 in that the vibration mass $m_1$ is provided with fastening means, for example, tapped holes with matching bolts 3 for fastening thereto an additional mass $m_2$. The mass $m_1$ or $m_2$ respectively is chosen so that it is not allowed the soil 2 to require a dynamic power D from the vibration device 1 which this vibration device 1 cannot supply.

The foregoing will be elucidated with reference to formulae $$F = C_1 \cdot b^2 \cdot m_{ex} \cdot r_{ex} \quad (1)$$

$$V = C_2 \cdot n \cdot a \quad (2)$$

$$D = \tfrac{1}{2} F \cdot V \quad (3)$$

$$a = \frac{m_{ex} \cdot r_{ex}}{m_1} \quad (4)$$

-continued $$(1) + (2) + (4) \text{ yield } D = \frac{\tfrac{1}{2} \cdot C_3 \cdot n^3 \cdot m^2_{ex} \cdot r^2_{ex}}{m_1} \quad (5)$$

wherein represent:

F the centrifugal force or the maximum of the alternation in the vibration force of the eccentric weights 7, n the number of revolutions of the eccentric weights 7, $m_{ex}$ the eccentric mass i.e. the imbalance of the eccentric mass, $r_{ex}$ the radius of the imbalance of the eccentric mass, which frequently has a constant value with a given vibration source 4, a the vibration amplitude of the vibration mass $m_1$, $c_1$, $c_2$, $c_3$ constant values, V the speed with which the vibration mass $m_1$ moves up and down during the vibration and D the dynamic power of the device 1 by which soil 2 can be worked.

When the soil 2 is worked by the device 1 embodying the invention, a schematic mass spring system as shown in FIG. 11 is produced. The vibration mass $m_1$ moves along with the soil mass $m_{g1}$, which may be considered to be coupled herewith. The soil mass $m_{g1}$ is elastic and damped with respect to a second soil mass $m_{g2}$ and this second soil mass $m_{g2}$, in turn, is elastically supported and damped with respect to the soil 40.

In reality distinction should be made between various kinds of dynamic power indicated in FIG. 7, i.e.

apparent power $D_s$, idle power $D_b$ and working power $D_w$.

The angle q is a measure for the generated damping. The idle power $D_b$ is equal to the apparent power $D_s$ when there is no damping, that is to say, when the angle q is 90°. The idle power $D_b$ supplied by the vibration device 1 is invariably at an angle of 90° to the working power $D_2$. With a decrease of the angle q and hence with an increase of the damping of the soil the dynamic working power $D_w$ to be supplied by the vibration device 1 is raised so that there is a risk that the number of revolutions n of the vibration source 4 should drop below its maximum, as a result of which the working power $D_w$ further decreases. In order to avoid this the vibration mass $m_1$ is varied in accordance with the invention.

From (5) it appears that with a given device 1 the dynamic power $D_s$ to be imparted to the soil is inversely proportional to the mass $m_1$. If the soil 2 cannot be sufficiently compacted with the mass $m_1$ because due to an excessively strong internal damping the soil 2 tends to excessively brake the device 1, the mass $m_1$ is increased by fastening an additional mass $m_2$ to mass $m_1$ by means of bolts 3 as shown in FIG. 2. As shown in FIG. 7 the mass $m_2$ may be formed by a sequence of interconnected weights 11. The dynamic working power $D_w$ to be supplied by the device 1 decreases by the additional mass $m_2$, it is true, but the eccentric weights 7 can be driven as before with the maximum rate n or the maximum force F respectively so that under these conditions the device 1 has an optimum effect on this soil 2.

The dynamic power $D_w$ supplied by the device 1 to the soil 2 is adapted by the addition of the mass $m_2$ to the energy absorption power or the damping value of the soil 2. When the vibration mass is increased, the required compaction time will increase. Important, however, is that the soil 2 can be satisfactorily compacted by this device 1 and more rapidly so than by means of the known method and the known device. The dynamic working power $D_w$ absorbed by the soil 2 is $\frac{1}{2}.C_4.n^3.m_{ex}.r_{ex}.a.\tan q$, wherein $C_4$ represents a constant and tan q corresponds to the damping behaviour of the soil. By lowering the amplitude a the required dynamic power is reduced. The amplitude a is $$\frac{m_{ex} \cdot r_{ex}}{m_1}$$

and is reduced by decreasing the vibration mass.

In order to avoid that the vibration mass $m_1$ should vagabond, i.e. gets free of the soil in an unpredictable and inefficient manner in striking the soil 2, the vibration mass $m_1$ of FIG. 3 is charged by a ballast mass $m_3$, which is vibration-dynamically isolated from the vibration mass $m_1$ by means of springs 14. In this way the vibration mass $m_1$ is kept coupled with the soil 2.

As shown in FIG. 4, as compared with FIG. 3, the load of the vibration mass $m_1$ is set by maintaining the mass $m_3$ at a fixed height h above the vibration mass $m_1$ by which the bias tension of the springs 14 is set at a desired value determining the load. When the damping of the soil 2 is very high, the mass $m_3$ is elevated because at an increased height h the static surface pressure on the soil 2 is reduced. Then the dynamic power injected by the device 1 into the soil 2 is lower. This is necessary when the driving power of the device is transiently insufficient.

If the soil structure is such that the vibration mass $m_1$ would sink too rapidly into the soil 2, the compaction of the soil would not be sufficient in the surroundings of the compaction centre. Then the ballast mass $m_3$ is slightly lifted so that the surface pressure on the soil 2 becomes lower and hence the compaction time is prolonged and hence the effect outside the vibration centre is improved.

The elevation of the ballast mass $m_3$ is performed, as shown in FIG. 4, by means of hydraulic jacks 15 or screw jacks, which are bolted (3) to a carrier mass $m_4$ bearing on the soil 2. By drawing in the jacks 15 the carrier mass $m_4$ can be suspended to the ballast mass $m_3$ in order to maximize the load of the vibration mass $m_1$. The highest coupling force by which the vibration mass $m_1$ can be coupled with the soil 2 is equal to the overall weight of the mass $m_1+m_2+m_3+m_4$. As long as the centrifugal force F is lower than said coupling force the soil 2 vibrates together with the vibration mass $m_1$. When the coupling force is exceeded, the vibration mass $m_1$ gets free of the soil and strikes the soil 2 each time. The discoupling force is adjustable by varying the vibration mass $m_1$ and/or the load thereof. In order to obtain a maximum compaction effect, for example, in the case in which the vibration mass $m_1$ does not sink further into the soil 2, as much ballast mass $m_3(+m_4)$ as possible is charged whilst maintaining the maximum rate n.

After being discoupled from the soil 2 the vibration mass $m_1$ starts striking the soil 2 with high impact force which may be even amount up to an order of magnitude of 5 or more of the centrifugal force F of the eccentric weights 7.

The carrier mass $m_4$ preferably consists of a wagon 16 carrying the pump aggregate 31 and enveloping the mass $m_1$ and having caterpillars 17, x which wagon is driven stepwise across the soil 2 to be compacted, whilst each time the wagon 16 is lifted as shown in FIG. 6.

The important advantage of the method and device 1 embodying the invention resides in the periodically working compaction force which can transfer much more energy per hour to the soil 2 than a force working the soil 2 at intervals and, each time, only during a fraction of a second.

The device 1 of FIG. 16 corresponds with the device 1 of FIG. 3 but for the ballast mass $m_3$ which can be coupled by means of hooks 99 in a position indicated by broken lines with the mass $m_1$ in order to be vibrated together with the mass $m_1$ when it is desired to increase the mass $m_1$.

Each of the vibration masses $m_1$ of FIGS. 1 to 6 may, as the case may be, be fastened according to the circumstances to one of the directing members 18, 19 or 20 in FIGS. 8, 9 and 10 respectively by means of bolts 3. By the directing member 18 a high local spot load can be charged on the soil 2. By the directing member 19 a continuous channel can be made in the soil when it is moved in the direction 21 during the compaction process. Preferably the vibration source 4 is fastened to the directing means 19 at an acute angle to the horizon.

By the directing member 20 the vibration energy can be slightly better directed downwards to a central zone 22 because the energy radiation towards the surroundings of the place of treatment is counteracted. In this way it is avoided that the soil should be pushed upwards at the side of the place of treatment.

In order to adapt the supporting surface by which the vibration mass $m_1$ bears on the soil 2 to the nature of the soil, it is preferred to fasten a supporting member 24 by bolts 3 to the underside of the vibration mass $m_1$, said member having a bottom surface 25 of a selected surface magnitude of, for example, 4 to 20 sq. ms (see FIG. 13). Preferably the device 1 has a plurality of exchangeable supporting members 24 of different surface magnitudes on the undersides. The supporting members 24 may be porous, in particular when a humid soil or a subaqueous soil has to be compacted.

With regard to the methods described two kinds of proportioning are given below, by way of example, viz. a low and a high one. Although it may be conceived that the proportioning is lower than the low proportioning indicated or higher than the high proportioning, in practice the proportioning will usually lie between these two examples for a satisfactory, efficient operation.

Preferably the proportioning is of the order of magnitude of the high proportioning.

| | low proportioning | medium proportioning | high proportioning |
|---|---|---|---|
| centrifugal force F | 1,200 kN | 3,000 kN | 20,000 kN |
| alternating vibration force vibration mass | 2% to 6% of F | 3% to 8% of F | 3% to 8% of F |

-continued

| | low proportioning | medium proportioning | high proportioning |
|---|---|---|---|
| $m_1$ corresponding to | 50 gs to 16,7 gs | 33 gs to 12,5 gs wherein g = 9,81 m/s$^2$ | 33 gs to 12,5 gs |
| vibration mass $m_1$ | 2400 to 7200 kgs | 9000–24000 kgs | 60000–160000 kgs |
| $m_1 + m_2$ | 130% to 150% of $m_1$ at $m_1$ = 2400 kgs to 7200 kgs | 130% to 150% of $m_1$ at $m_1$ = 9000 kgs to 15000 kgs 110% to 130% of $m_1$ at $m_1$ = 15000 kgs to 24000 kgs | 130% to 150% of $m_1$ at $m_1$ = 65000 kgs to 100000 kgs 110% to 130% of $m_1$ at $m_1$ = 100000 kgs to 160000 kgs |
| $m_4$ = e.g. | 50% to 100% | 50% to 100% of ($m_3 + m_4$) | 50% to 100% of ($m_3 + m_4$) |
| actively generated alternating pressure on the soil surface | 5 to 14 bars | 5 to 14 bars | 5 to 14 bars |
| actively generated impact pressure | 15 to 42 bars | 15 to 42 bars | 15 to 41 bars |
| active impact force | 3,600 kN | more than 9,000 kN | to 60,000 kN |
| dynamic work power $D_w$ deflected into the soil | 120 to 360 kw | 300 to 900 kw | 2000 to 6000 kw |
| vibration frequency at max. rate n | 10 to 30 Hz | 10 to 30 Hz | 10 to 30 Hz |
| compaction depth | 1 to 4 ms | 1 to 10 ms | 1 to 16 ms |
| compaction time per compaction run at a compaction place | 30 to 180 s | 30 to 180 s | 30 to 180 s |

It is particularly important that the actively generated alternating pressure on the soil surface should be high in order to enable compacting at a great depth. It should be at least 2 bars, but preferably it is 5 to 14 bars or even higher.

In the device 1 of FIG. 12 the mass $m_3$ is practically nil and all mass $m_3+m_4$ is arranged low near the ground 2 on the vehicle 16 as a mass $m_4$ so that the device 1 is stable. The hydraulic jacks 15 of FIG. 12 fastened to a high frame 28 fastened to the wagon 16 are long so that a great variation in length of the springs 14 and hence a great variation of the load are possible.

Preferaby the vibration mass $m_1$ is adapted to the damping factor tan q of the soil in a sense such that with an increase in damping, that is to say, with a decrease of tan q the mass $m_1$ is increased so that the vibration amplitude is reduced. The value of tan q can be determined by measuring the speed $v_w$ or the acceleration $\ddot{a}_w$ of the mass $m_1$ during the compaction process by means of a meter 33 and by determining the tan q by dividing the velocity $v_w$ or the acceleration $\ddot{a}_2$ by the calculated or measured idle velocity $v_b$ or the idle acceleration $\ddot{a}_b$ of the freely suspended mass $m_1$. The tan q may also be determined by measuring the force $F_w$ during the vibration process and by dividing the same by the measured or calculated centrifugal force $F_b$ occurring in a free suspension of the mass $m_1$.

Expressed in a formula:

$$\tan q = v_w/v_b = \ddot{a}_2/\ddot{a}_b = F_w/F_b$$

Of essential importance therein is that the produced alternating force F should vary with the square of the rotation frequency corresponding to $F=2.4.m'$ and the vibration dynamic apparent power $P_s$ to the third power of the rotation frequency corresponding to $P_s=\frac{1}{2}.3.r.m'.s$, wherein m' is the eccentric mass. The vibration impact compactor works through the impact plate with the static force $(m_1+m_2)$ g on the soil body, which is regarded theoretically as an elastic, isotropic half space. By raising the number of revolutions of the generator to the alternating force F, which is higher than $(m_1+m_2)g$, the impact plate of the vibration impact compactor discouples from the soil body and starts striking.

FIG. 13 shows a harmonic vibration diagram of a vibration mass $m_1$ vibrating with the soil.

FIG. 14 shows a harmonic vibration diagram of a vibration mass $m_1$ each time getting free of the soil, the vibration mass $m_1$ each time striking the soil with a heavy force.

FIG. 15 shows a superharmonic vibration diagram in which the vibration mass $m_1$ strikes the soil with a very heavy force every other cycle, thus transferring much energy to the soil. Particularly for working deep soil the vibration treatment of FIG. 15 is highly effective.

For clay containing soil with a high water content the vibration diagram of FIG. 13 is more to the optimum than that of FIG. 14. In the case of sand the vibration diagram of FIG. 14 is more to the optimum than that of FIG. 13. With both kinds of soil the vibration diagram of FIG. 15 is more efficient.

With an efficient compaction the vibration mass $m_1$ has to be governed. The so-called vagabonding has to be avoided. After the determination of the vibration diagram control can be performed by varying the mass $m_1(+m_2)$. The ballast mass $m_3(+m_4)$ and/or the rate of the vibration source may be varied. Preferably, during the compaction a vibration diagram is recorded by recording means 4 connected with the pick-up 33 in order to prove the effect during compaction and afterwards the adequate compaction.

In compacting soil at a great depth below the surface it is ensured that in particular the alternating force F is high.

During the vibration process the measuring data picked up by pick-up means 33 are preferably recorded by means of recording means 98 connected to the pick-up means 33. Preferably a recorder records the vibration behaviour of the mass spring system of the device 1 of which the soil mass forms part. From the recorded image presented, for example, in the form of FIG. 13, 14 or 15, the compaction degree of the soil can be derived. Moreover, with the aid of the recording means 98 are recorded the vibration masses used, the vibration frequency and the ballast masses used.

Figure 1:
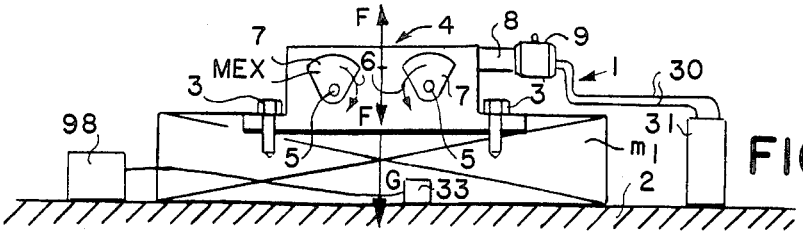
Figure 2:
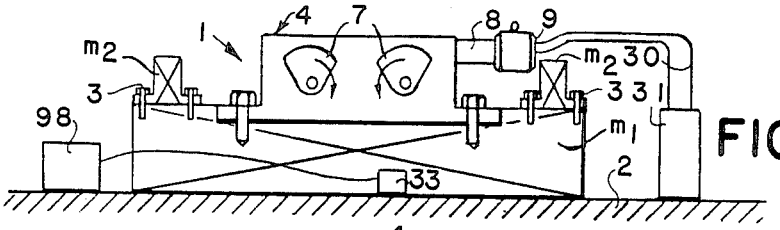
Figure 3:
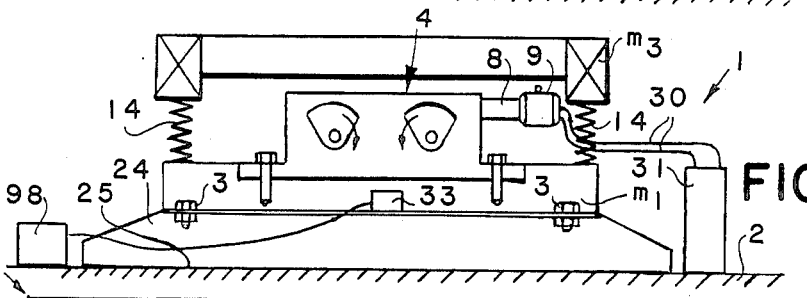
Figure 4:
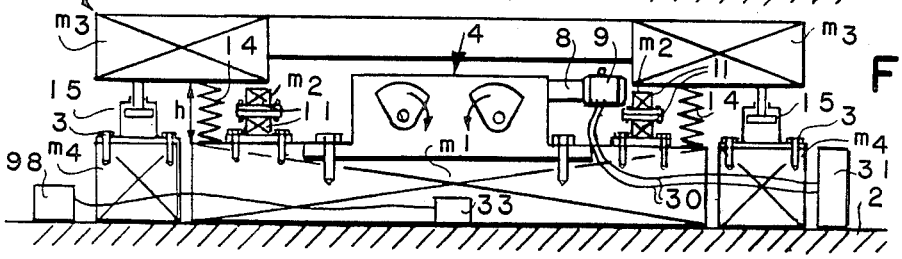
Figure 5:
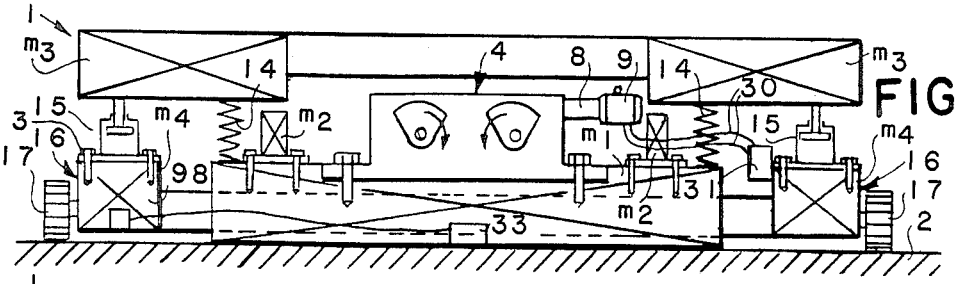
Figure 6:
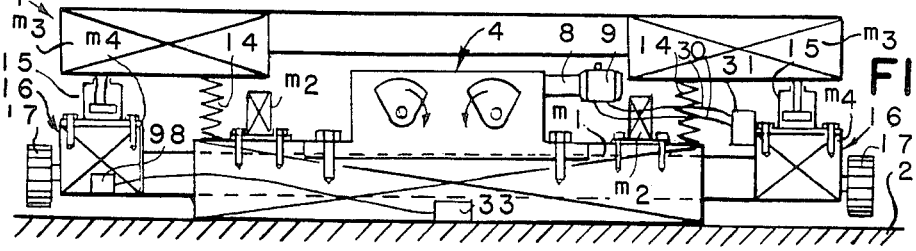
Figure 16:
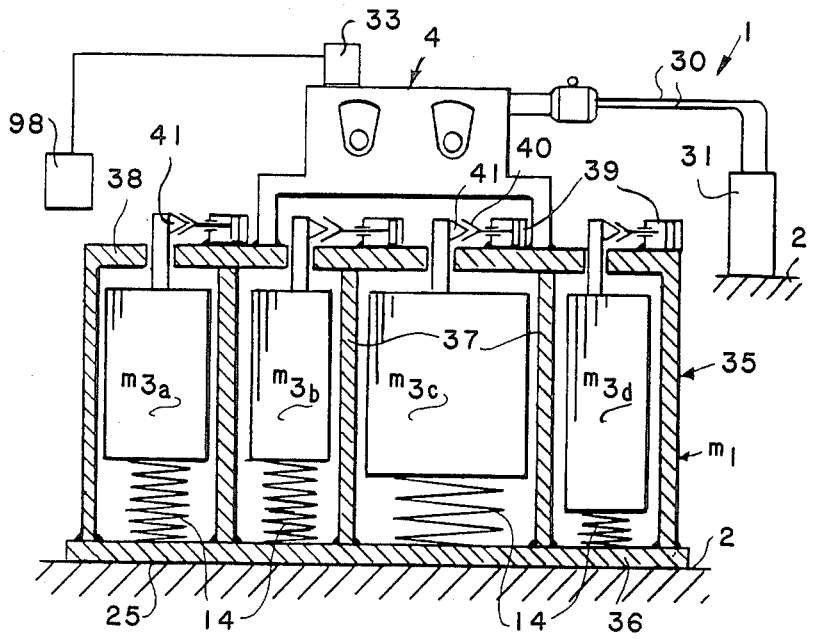

In the method and device 1 of FIG. 16 the mass $m_1$ is formed by a rugged, but relatively light-weight casing 35 to which a vibration source 4 is fastened, for example, by welding. On the bottom 36 of the casing 35 are bearing coupling masses $m_{3b}$, $m_{3c}$ and $m_{3d}$ through springs 14, whilst these coupling masses are guided in the casing 35 by means of partitions 37. The cover 38 of the casing 35 has slidably fastened to it lock bolts 40 actuated by means of hydraulic jacks 39 and engaging heads 41 of the coupling masses 3*a* to 3*d* to block them.

According to need given masses or a given combination of coupling masses are connected with the casing 35 so that the vibration mass $m_1$ is increased with a given number of coupling masses. Preferably the coupling masses $m_{3a}$, $m_{3b}$, $m_{3c}$ and $m_{3d}$ have relatively different sizes.

Figure 17:
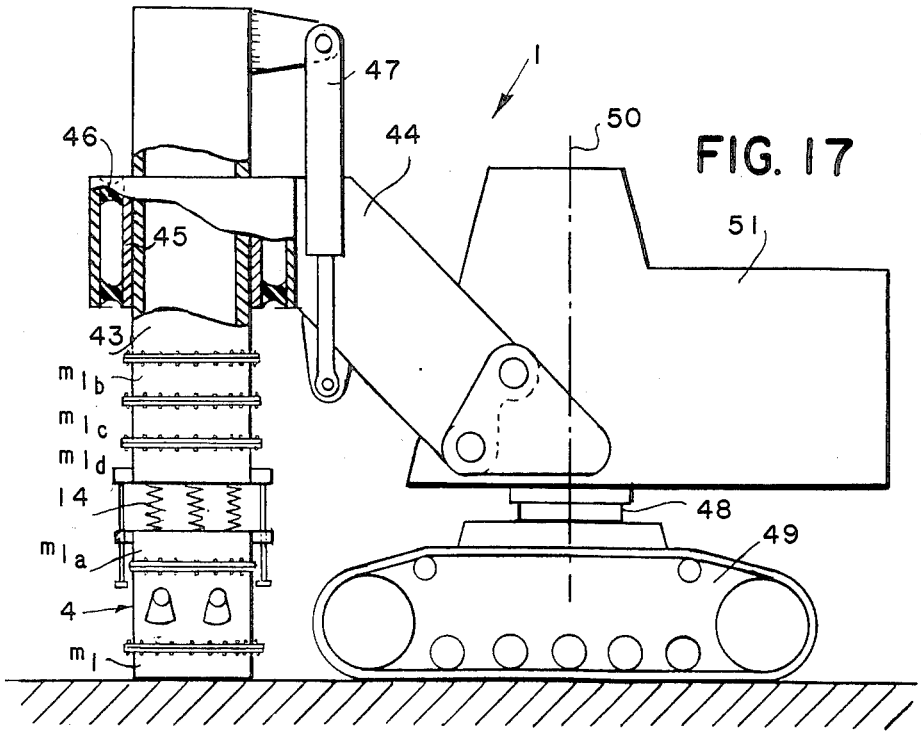

The device 1 of FIG. 17 comprises a mass $m_1$ with which a vibration source 4 is coupled. Thereto is fastened an additional mass $m_{2a}$, which is loaded, in turn, through rubber springs 14 by ballast masses $m_{3b}$, $m_{3c}$ and $m_{3d}$. It is conceivable to arrange the ballast masses $m_{3b}$, $m_{3c}$ and/or $m_{3d}$ as an additional vibration mass below the springs 14. The assembly of mass $m_1$ with vibration source and ballast masses is arranged at the lower end of a column 43, which is guided up and down in an arm 44 by means of a guide sleeve 45, which is arranged vibration-free by means of rubber blocks 46 in the arm 44. The top end of the column 43 bears on the arm 44 of a superstructure 51 through a hydraulic jack 47 of adjustable length. The superstructure 51 is rotatable about a vertical axis 50 by means of a rotating crown 48 and fastened to a caterpillar track 49. By shortening the jack 47 a large part of the weight of the superstructure 51 with the caterpillar track 49 connected herewith is arranged as a ballast mass on the vibration mass $m_1$.

It should be noted that the column 43 might be pivotally arranged on the superstructure 51 rather than being vertically guided, in which case the hydraulic jack 47 connects the column 43 with the superstructure 51.

The device 1 of FIG. 18 comprises a vibration source 4 with a mass $m_1$ arranged on a vibration needle 60 to be inserted into the soil, the lower end of the needle being provided with resonance blades 61. With the axial vibration load of the vibration needle 60 by the vibration source 4 the resonance blades 61 are subjected to a tangential movement about the axis 62 so that the surrounding soil is effectively compacted. The vibration source 4 and hence the vibration needle 60 is loaded through springs 14 by a ballast mass $m_3$. The vibration source 4 is suspended to a cable 70 of a mobile lifting device 71, which carries, in addition, an electric energy generating aggregate 72 for driving the vibration source 4.

I claim:

1. The method of compacting soil while taking into account the mass and damping behavior of the soil being compacted, which comprises the steps of:

(a) compacting soil to an initial extent and at an initial rate of compaction by engaging a first mass on the soil to impart an initial first weight thereon and subjecting the first mass to a substantially vertical initial oscillating force determined by an initial frequency of oscillation and an initial weight value of the first mass, (b) determining the damping factor the compaction of step (a) has on the soil, and (c) thereafter compacting the soil to a second extent of compaction and at a second rate of compaction, different from the initial extent of compaction and the initial rate of compaction, in which the second extent and the second rate are different from the initial extent and the initial rate in accord with the determination of step (b).

2. The method as defined in claim 1 wherein the initial value of the first weight is adjusted in step (c).

3. The method as defined in claim 2 wherein the initial value of the first weight is adjusted in step (c) by varying the initial weight value of the first mass.

4. The method as defined in claim 1 wherein the first mass is resiliently suspended and the initial value of the first weight is adjusted in step (c) by changing the suspension of the first mass.

5. The method as defined in claim 4 wherein the first mass is suspended from a mobile mass bearing upon and movable over the ground surface.

6. The method as defined in claim 4 wherein the first mass is suspended from a ballast mass.

7. The method as defined in claim 6 wherein the ballast mass is carried by a mobile mass bearing upon and movable over the ground surface.

8. The method as defined in claim 7 wherein the ballast mass is vertically adjusted with respect to the mobile mass.

9. The method of compacting soil which has an unknown response to compaction due to the effect of its mass and damping behavior during compaction, which comprises the steps of:

(a) compacting the soil by engaging a compacting mass on the soil and subjecting the compacting mass to a substantially vertical oscillating force, (b) repeating step (a) at least once after changing the weight of the compacting mass, and (c) selecting the weight of the compacting mass from the best compaction results of steps (a) and (b) and further compacting the soil with the selected weight of the compacting mass.

10. A device for compacting soil which comprises a compacting mass having a predetermined weight adapted to bear upon the surface of soil to be compacted, vibrating means mounted on said compacting mass for imparting oscillatory motion thereto so that soil is compacted while exerting a damped spring force upon the compacting mass, pick-up means for detecting the damping factor of the soil after being compacted for a finite time, and control means for altering the vibratory nature of the compacting mass in accord with the damping factor detected by said pick-up means.

11. A device as defined in claim 10 wherein said control means includes means for resiliently altering weight loading of said compacting mass.

12. A device as defined in claim 10 wherein said control means comprises additional weights added to said compacting mass.

13. A device as defined in claim 10 including a mobile frame mounting said compacting mass.

14. A device as defined in claim 13 including spring means for resiliently suspending said compacting mass from said frame, and adjustment means on said frame for vertically adjusting the point from which the compacting mass is suspended.

15. A device as defined in claim 14 wherein said frame includes a ballast weight vertically movable by said adjustment means, said spring means being connected to the ballast weight to suspend the compacting mass therefrom whereby a greater or lesser amount of the ballast weight is transferred to the compacting mass in response to vertical adjustment of the adjusting means.

* * * * *